US009257068B2

(12) United States Patent
Kim et al.

(10) Patent No.: US 9,257,068 B2
(45) Date of Patent: Feb. 9, 2016

(54) ORGANIC LIGHT EMITTING DISPLAY DEVICE INCLUDING A REDUNDANT ELEMENT FOR A TEST GATE LINE

(71) Applicants: Young-Kwang Kim, Yongin (KR); Hyun-Uk Oh, Yongin (KR)

(72) Inventors: Young-Kwang Kim, Yongin (KR); Hyun-Uk Oh, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 353 days.

(21) Appl. No.: 13/960,115

(22) Filed: Aug. 6, 2013

(65) Prior Publication Data

US 2014/0167769 A1 Jun. 19, 2014

(30) Foreign Application Priority Data

Dec. 14, 2012 (KR) ..... 10-2012-0146369

(51) Int. Cl.
*G09G 3/00* (2006.01)
*G09G 3/32* (2006.01)

(52) U.S. Cl.
CPC ..... *G09G 3/3208* (2013.01); *G09G 3/006* (2013.01); *G09G 2300/0426* (2013.01); *G09G 2330/04* (2013.01)

(58) Field of Classification Search
CPC . G09G 3/006; G09G 3/3208; G09G 2230/04; G09G 2300/0426
See application file for complete search history.

(56) References Cited

U.S. PATENT DOCUMENTS

2008/0054798 A1 3/2008 Jeong et al.
2008/0068309 A1* 3/2008 Kwak ..... G09G 3/006 345/82
2009/0278835 A1* 11/2009 Ka ..... G09G 3/006 345/211
2011/0043500 A1 2/2011 Kwak et al.
2011/0080173 A1 4/2011 Kim et al.
2011/0175882 A1* 7/2011 Stryakhilev ..... G09G 3/3233 345/211

FOREIGN PATENT DOCUMENTS

KR 10-0732819 B1 6/2007
KR 10-1015312 B1 2/2011
KR 10-2011-0037638 A 4/2011

* cited by examiner

*Primary Examiner* — Jeff Natalini
(74) *Attorney, Agent, or Firm* — Lee & Morse, P.C.

(57) ABSTRACT

An organic light emitting display device according to example embodiments includes a display unit, a test data line to which a test data voltage is applied during a sheet unit test, a test gate line to which a first voltage is applied during the sheet unit test and to which a second voltage is applied during a normal operation of the organic light emitting display device, a plurality of test transistors configured to selectively couple the test data line to a plurality of data lines in the display unit in accordance with a voltage provided by the test gate line, and at least one redundant element configured to maintain the test gate line at the second voltage during the normal operation even if the test gate line is damaged.

20 Claims, 9 Drawing Sheets

700

ORGANIC LIGHT EMITTING DISPLAY DEVICE INCLUDING A REDUNDANT ELEMENT FOR A TEST GATE LINE

CROSS REFERENCE TO RELATED APPLICATION

This application claims priority under 35 U.S.C. §119 to Korean Patent Application No. 10-2012-0146369 filed on Dec. 14, 2012, the disclosure of which is hereby incorporated by reference herein in its entirety.

BACKGROUND

1. Field

Example embodiments of the inventive concept relate to display devices. More particularly, example embodiments of the inventive concept relate to organic light emitting display devices where a sheet unit test is performed.

2. Description of the Related Art

In order to effectively produce a large number of organic light emitting display devices, a production method of "sheet unit" has been developed in which panels of a plurality of organic light emitting display devices are formed on one mother substrate and then scribed into separate panels.

Tests for the separate panels of the organic light emitting display devices may be performed on each panel by a panel unit test apparatus. However, in this case, since the panels must be separately tested, the efficiency of the test deteriorates.

One way to address this deterioration is to perform the test in unit of sheet before the panels are separated from the mother substrate, and the test performed in unit of sheet may be referred to as a "sheet unit test." To accomplish this, a plurality of sheet unit lines for supplying power and/or signals for performing the sheet unit test to the plurality of panels are designed on the mother substrate. The sheet unit test may improve the efficiency of the test. However, if the plurality of sheet unit lines, or dedicated test lines for the sheet unit test are damaged, an organic light emitting display device may display an abnormal image even after the organic light emitting display device is separated from the mother substrate.

SUMMARY

Example embodiments provide an organic light emitting display device capable of preventing an abnormal image from being displayed even if test lines for a sheet unit test are damaged.

According to one aspect of example embodiments, there is provided an organic light emitting display device including a display unit including a plurality of pixels coupled to a plurality of scan lines and a plurality of data lines, a test data line to which a test data voltage is applied during a sheet unit test, a test gate line to which a first voltage is applied during the sheet unit test and to which a second voltage is applied during a normal operation of the organic light emitting display device, a plurality of test transistors configured to selectively couple the test data line to the plurality of data lines in response to the first voltage or the second voltage applied through the test gate line, an internal voltage line to which the second voltage is applied, and at least one voltage maintaining transistor configured to couple the internal voltage line to the test gate line during the normal operation.

In example embodiments, during the sheet unit test, the at least one voltage maintaining transistor may be turned off to decouple the internal voltage line from the test gate line, and, during the normal operation, the at least one voltage maintaining transistor may be turned on to couple the internal voltage line to the test gate line such that the test gate line maintains the second voltage even if the test gate line is damaged.

In example embodiments, the organic light emitting display device may further include a control voltage line coupled to the at least one voltage maintaining transistor. The second voltage may be applied to the control voltage line during the sheet unit test, and the first voltage may be applied to the control voltage line during the normal operation.

In example embodiments, the at least one voltage maintaining transistor may have a gate terminal coupled to the control voltage line, a source terminal coupled to the internal voltage line, and a drain terminal coupled to the test gate line.

In example embodiments, the at least one voltage maintaining transistor may include a plurality of voltage maintaining transistors, each voltage maintaining transistor having a gate terminal coupled to the control voltage line, a source terminal coupled to the internal voltage line, and a drain terminal coupled to the test gate line.

In example embodiments, the at least one voltage maintaining transistor may include a first voltage maintaining transistor having a gate terminal coupled to the control voltage line, a source terminal coupled to the internal voltage line, and a drain terminal coupled to the test gate line, the first voltage maintaining transistor being disposed in a first direction from the displaying unit, and a second voltage maintaining transistor having a gate terminal coupled to the control voltage line, a source terminal coupled to the internal voltage line, and a drain terminal coupled to the test gate line, the second voltage maintaining transistor being disposed in a second direction opposite to the first direction from the displaying unit.

In example embodiments, the plurality of test transistors may be configured to couple the test data line to the plurality of data lines in response to the first voltage applied through the test gate line during the sheet unit test, and may be configured to decouple the test data line from the plurality of data lines in response to the second voltage applied through the test gate line during the normal operation.

In example embodiments, the plurality of test transistors and the at least one voltage maintaining transistor may be implemented with PMOS transistors.

In example embodiments, the first voltage may be a low gate voltage, and the second voltage may be a high gate voltage.

In example embodiments, the plurality of test transistors and the at least one voltage maintaining transistor may be implemented with NMOS transistors.

In example embodiments, the first voltage may be a high gate voltage, and the second voltage may be a low gate voltage.

According to another aspect of example embodiments, there is provided an organic light emitting display device including a display unit including a plurality of pixels coupled to a plurality of scan lines and a plurality of data lines, a test data line to which a test data voltage is applied during a sheet unit test, a first test gate line to which a first voltage is applied during the sheet unit test and to which a second voltage is applied during a normal operation of the organic light emitting display device, a plurality of first test transistors configured to selectively couple the test data line to a plurality of nodes in response to the first voltage or the second voltage applied through the first test gate line, a second test gate line to which the first voltage is applied during the sheet unit test and to which the second voltage is applied during the normal operation, and a plurality of second test transistors configured to selectively couple the plurality of nodes to the plurality of data lines in response to the first voltage or the second voltage applied through the second test gate line, each of the second test transistors being coupled in series with a corresponding one of the first test transistors.

In example embodiments, the first test gate line may be disposed in a first direction from the displaying unit, and the second test gate line may be disposed in a second direction opposite to the first direction from the displaying unit.

In example embodiments, the first test transistors may be configured to couple the test data line to the plurality of nodes in response to the first voltage applied through the first test gate line during the sheet unit test, and the second test transistors may be configured to couple the plurality of nodes to the plurality of data lines in response to the first voltage applied through the second test gate line during the sheet unit test.

In example embodiments, even if one of the first and second test gate lines is damaged, the first test transistors or the second test transistors coupled to the other one of the first and second test gate lines may decouple the test data line from the plurality of data lines in response to the second voltage applied through the other one of the first and second test gate lines during the normal operation.

In example embodiments, each of the first test transistors may be a gate terminal coupled to the first test gate line, a source terminal coupled to the test data line, and a drain terminal coupled to a corresponding one of the plurality of nodes, and wherein each of the second test transistors may have a gate terminal coupled to the second test gate line, a source terminal coupled to a corresponding one of the plurality of nodes, and a drain terminal coupled to a corresponding one of the plurality of data lines.

In example embodiments, the first test transistors and the second test transistors may be implemented with PMOS transistors.

In example embodiments, the first voltage may be a low gate voltage, and the second voltage is a high gate voltage.

In example embodiments, the first test transistors and the second test transistors may be implemented with NMOS transistors.

In example embodiments, the first voltage may be a high gate voltage, and the second voltage is a low gate voltage.

BRIEF DESCRIPTION OF THE DRAWINGS

Example embodiments can be understood in more detail from the following description taken in conjunction with the accompanying drawings, in which.

DETAILED DESCRIPTION

Figure 1:
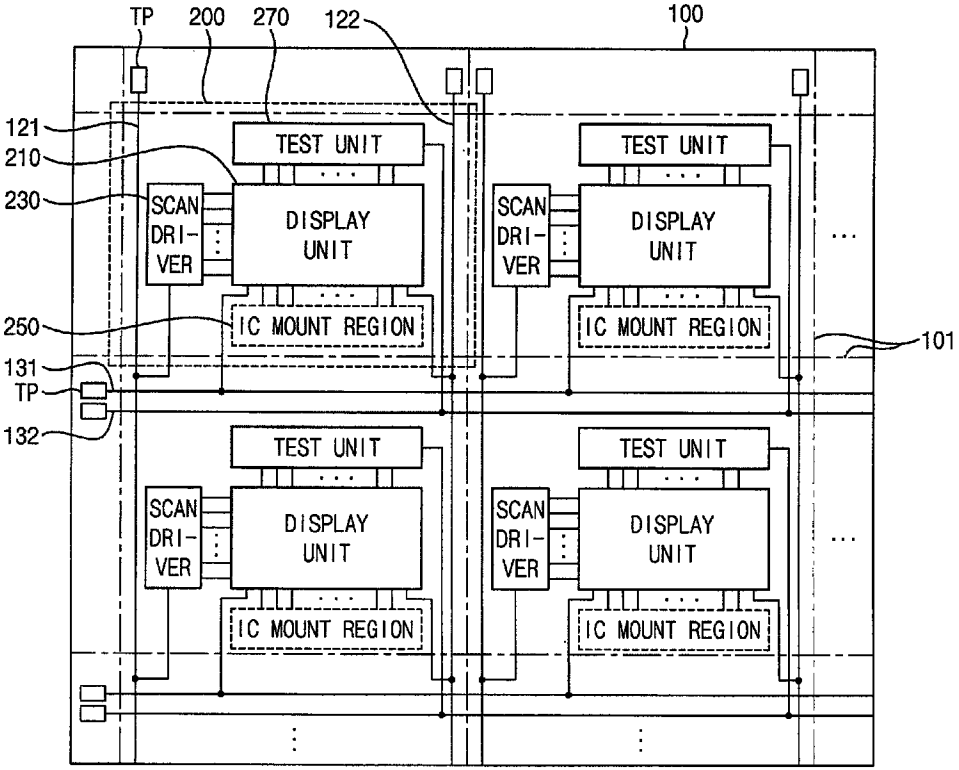
FIG. 1 is a diagram illustrating a mother substrate of an organic light emitting display device in accordance with example embodiments.

The example embodiments are described more fully hereinafter with reference to the accompanying drawings. The inventive concept may, however, be embodied in many different forms and should not be construed as limited to the example embodiments set forth herein. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms. These terms are only used to distinguish one element, component, region, layer pattern or section from another region, layer, pattern or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the inventive concept. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the inventive concept.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a diagram illustrating a mother substrate of an organic light emitting display device in accordance with example embodiments. Referring to FIG. 1, a mother substrate 100 includes a plurality of organic light emitting display devices 200 arranged in a matrix, and sheet unit lines 121, 122, 131, and 132 located at outside regions of the organic light emitting display devices 200.

Each organic light emitting display device 200 may include a display unit 210, a scan driver 230, an integrated circuit (IC) mounting region 250, and a test unit 270. The display unit 210 includes a plurality of pixels coupled to a plurality of scan lines and a plurality of data lines. Each pixel included in the display unit 210 may include red, green, and blue sub-pixels. In some example embodiments, the red, green, and blue sub-pixels may include red, green, and blue organic light emitting diodes that emit red light, green light, and blue right, respectively. In other example embodiments, the red, green, and blue sub-pixels may include white organic light emitting diodes that emit white light, and may further include red, green, and blue color filters, respectively. In still other example embodiments, each pixel included in the displaying unit 210 may have red, green, blue, and white sub-pixels. The red, green, and blue sub-pixels may include the white organic light emitting diodes, and may further include red, green, and blue color filters, respectively. The white sub-pixel may include the white organic light emitting diode without the color filter.

The scan driver 230 is coupled to the plurality of scan lines. The scan driver 230 may generate a scan signal based on a scan driving voltage and a scan control signal, and may sequentially apply the scan signal to the plurality of scan lines. The IC mounting region 250 may be coupled to first ends of the plurality of data lines and the test unit 270 may be coupled to second ends of the plurality of data lines. After the plurality of organic light emitting display devices 200 are scribed, separated, or otherwise divided into separate panels, a driving IC including a data driver and/or a timing controller may be mounted on the IC mounting region 250. During a sheet unit test, the test unit 270 may apply a test data voltage to the plurality of data lines in response to a test control voltage.

The sheet unit test may be performed simultaneously on the plurality of organic light emitting display devices 200 before the plurality of organic light emitting display devices 200 are separated from the mother substrate 100. The sheet unit test may include a lighting test. In some example embodiments, the sheet unit test may further include a leakage current test, an aging process test, etc.

The sheet unit test may be performed by applying predetermined signals to the sheet unit lines 121, 122, 131, and 132 located at outside regions of the organic light emitting display devices 200. Each sheet unit line 121, 122, 131, and 132 may extend in a row direction to simultaneously transfer the signals to the organic light emitting display devices 200 located at a corresponding row or may extend in a column direction to simultaneously transfer the signals to the organic light emitting display devices 200 located at a corresponding column.

For example, to perform the sheet unit test, the test control voltage and the test data voltage may be applied to at least one first sheet unit line 132 through at least one test pad TP, and the test unit 270 may receive the test control voltage and the test data voltage through the first sheet unit line 132. The test unit 270 may apply the test data voltage to the plurality of data lines in response to the test control voltage. Further, the scan driving voltage and the scan control signal may be applied to at least one second sheet unit line 121 through at least one test pad TP, and the scan driver 230 may receive the scan driving voltage and the scan control signal through the second sheet unit line 121. For example, the scan driving voltage may include a high scan driving voltage (or a high gate voltage) and a low scan driving voltage (or a low gate voltage), and the scan control signal may include a start pulse, a scan clock signal and an output enable signal. The scan driver 230 may sequentially apply the scan signal to the plurality of scan lines based on the scan driving voltage and the scan control signal. Thus, the test data voltage from the test unit 270 may be sequentially applied to the plurality of pixels included in the display unit 210 on a row basis. While the sheet unit test is performed, a first pixel power supply voltage (e.g., a high pixel power supply voltage (ELVDD)) may be applied to a third sheet unit line 122 through a test pad TP, a second pixel power supply voltage (e.g., a low pixel power supply voltage (ELVSS)) may be applied to a fourth sheet unit line 131 through a test pad TP, and the display unit 210 may receive the first and second pixel power supply voltages through the third and fourth sheet unit lines 122 and 131.

As described above, since the sheet unit test is performed simultaneously on the plurality of organic light emitting display devices 200, the time and cost of the test may be reduced, thereby improving the efficiency of the test.

After the sheet unit test is completed, the plurality of organic light emitting display devices 200 may be scribed, separated, or otherwise divided from the mother substrate 100 into separate organic light emitting display devices 200 along scribing lines 101. Electrical connection points between the sheet unit lines 121, 122, 131, and 132 and components 210, 230 and 270 of each organic light emitting display device 200 may be located outside of the scribing lines 101 of the organic light emitting display device 200. Thus, after the plurality of organic light emitting display devices 200 are scribed from the mother substrate 100, the sheet unit lines 121, 122, 131, and 132 may be electrically decoupled from the components (e.g., the display unit 210, the scan driver 230, the test unit 270, etc.) of each organic light emitting display device 200, and may not affect a normal operation of the organic light emitting display device 200.

Figure 2A:
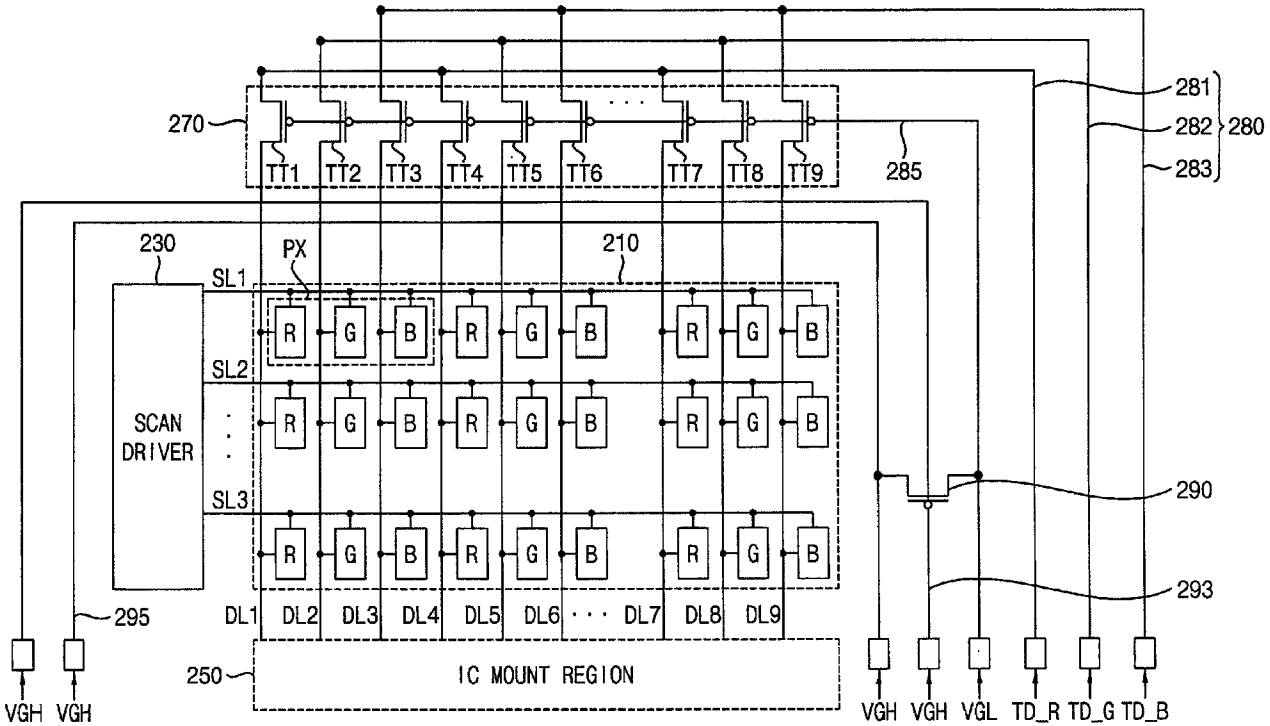
FIG. 2A is a diagram illustrating an organic light emitting display device before being separated from a mother substrate in accordance with example embodiments.
Figure 2B:
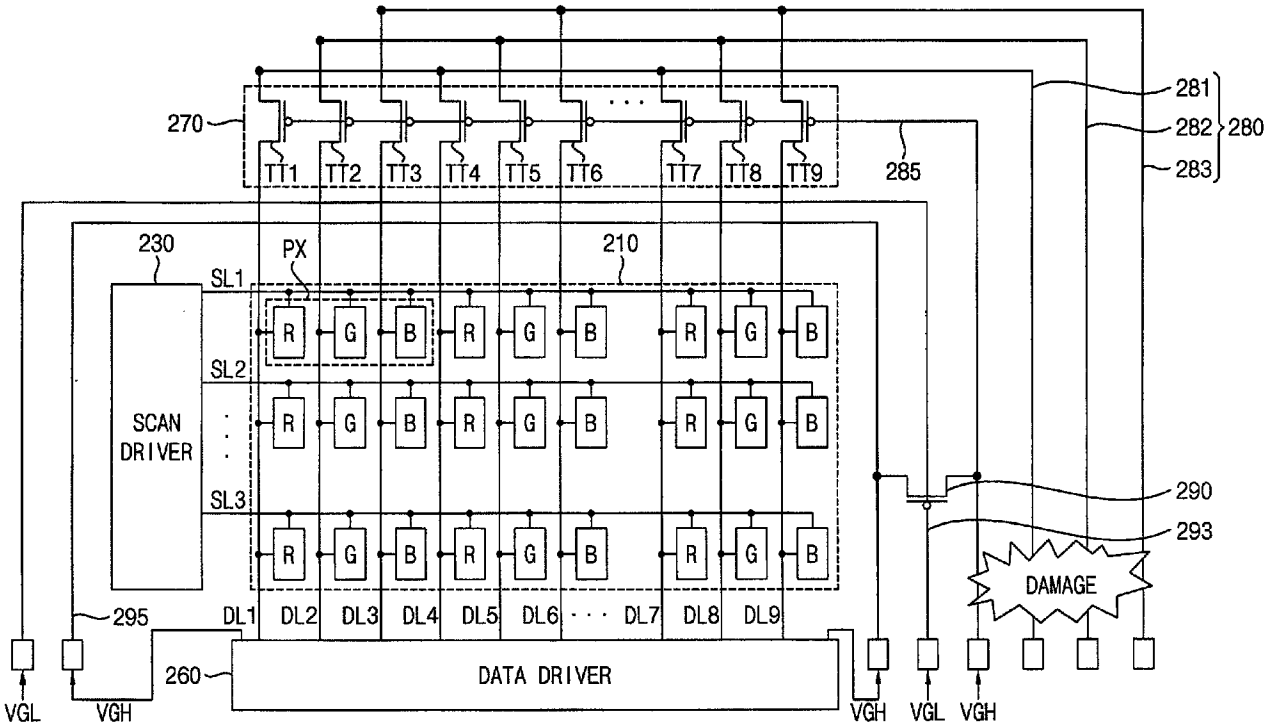
FIG. 2B is a diagram illustrating an organic light emitting display device after being separated from a mother substrate in accordance with example embodiments.

FIG. 2A is a diagram illustrating an organic light emitting display device before being separated from a mother substrate in accordance with example embodiments. FIG. 2B is a diagram illustrating an organic light emitting display device after being separated from a mother substrate in accordance with example embodiments.

Referring to FIGS. 2A and 2B, an organic light emitting display device 200*a* formed on a mother substrate 100 of FIG. 1 may include a display unit 210, a scan driver 230, an IC mounting region 250, a test unit 270, a test data line 280, a test gate line 285, a voltage maintaining transistor 290, a control voltage line 293, and an internal voltage line 295. After the organic light emitting display device 200*a* is separated from the mother substrate 100 of FIG. 1, an organic light emitting display device 200*b* may further include a driving IC mounted on the IC mounting region 250. In some example embodiments, the driving IC may be mounted on the IC mounting region 250 in a chip-on-glass (COG) manner, and may include a data driver 260 and/or a timing controller.

The display unit 210 may include a plurality of pixels PX coupled to a plurality of scan lines SL1, SL2, and SL3 and a plurality of data lines DL1, DL2, DL3, DL4, DL5, DL6, DL7, DL8, and DL9. Each pixel PX may include a red sub-pixel R, a green sub-pixel G, and a blue sub-pixel B. In some example embodiments, each pixel PX may further include a white sub-pixel.

The scan driver 230 may be coupled to the plurality of scan lines SL1, SL2, and SL3. The scan driver 230 may generate a scan signal based on a scan driving voltage and a scan control signal, and may sequentially apply the scan signal to the plurality of scan lines SL1, SL2, and SL3. In some example embodiments, the scan driver 230 may receive the scan driving voltage and the scan control signal through a sheet unit line 121 illustrated in FIG. 1 during a sheet unit test, and may receive the scan driving voltage and the scan control signal from the data driver 260 during a normal operation of the organic light emitting display device 200*b*. The scan driving voltage may include a high gate voltage VGH, and the scan driver 230 may receive the high gate voltage VGH through the internal voltage line 295 formed inside the organic light emitting display device 200*a* and 200*b* from the sheet unit line 121 of FIG. 1 during the sheet unit test or from the data driver 260 during the normal operation, respectively. The internal voltage line 295 formed outside the display unit 210 may receive the high gate voltage VGH during the sheet unit test and during the normal operation, and may transfer the high gate voltage VGH to the scan driver 230 and/or an emission driver. Although FIGS. 2A and 2B illustrate an example where the internal voltage line 295 may receive the high gate voltage VGH at both of the bottom left edge and the bottom right of the organic light emitting display device 200*a* and 200*b*, in some example embodiments, the internal voltage line 295 may receive the high gate voltage VGH at either the bottom left edge or the bottom right of the organic light emitting display device 200*a* and 200*b*. In some example embodiments, the organic light emitting display device 200*a* and 200*b* may further include another internal voltage line for receiving a low gate voltage VGL.

The IC mounting region 250 may be coupled to one ends of the plurality of data lines DL1, DL2, DL3, DL4, DL5, DL6, DL7, DL8, and DL9, and the test unit 270 may be coupled to the other ends of the plurality of data lines DL1, DL2, DL3, DL4, DL5, DL6, DL7, DL8, and DL9. During the sheet unit test, as illustrated in FIG. 2A, a test data voltage TD_R, TD_G, and TD_B may be applied to the plurality of data lines DL1, DL2, DL3, DL4, DL5, DL6, DL7, DL8, and DL9 through the test data line 280 and the test unit 270. After the organic light emitting display device 200*a* is separated from the mother substrate 100 of FIG. 1, the data driver 260 may be mounted on the IC mounting region 250. During the normal operation of the organic light emitting display device 200*b* after the data driver 260 is mounted, the data driver 260 may apply a data voltage corresponding to an image to be displayed by the display unit 210 to the plurality of data lines DL1, DL2, DL3, DL4, DL5, DL6, DL7, DL8, and DL9. In some example embodiments, the organic light emitting display device 200*a* and 200*b* may further include a switching unit between the data driver 260 and the display unit 210. The switching unit may sequentially apply the data voltage output from the data driver 260 in order of the red sub-pixels R, the green sub-pixels G, and the blue sub-pixels B to the plurality of data lines DL1, DL2, DL3, DL4, DL5, DL6, DL7, DL8, and DL9.

The test unit 270 may include a plurality of test transistors TT1, TT2, TT3, TT4, TT5, TT6, TT7, TT8, and TT9 between the test data line 280 and the plurality of data lines DL1, DL2, DL3, DL4, DL5, DL6, DL7, DL8, and DL9. Each test transistor TT1, TT2, TT3, TT4, TT5, TT6, TT7, TT8, and TT9 may include a gate terminal coupled to the test gate line 285, a source terminal coupled to the test data line 280, and a drain terminal coupled to a corresponding one of the plurality of data lines DL1, DL2, DL3, DL4, DL5, DL6, DL7, DL8, and DL9. The test data line 280 may include a first test data line 281 to which a red test data voltage TD_R is applied, a second test data line 282 to which a green test data voltage TD_G is applied, and a third test data line 283 to which a blue test data voltage TD_B is applied. In a case where each pixel PX of the display unit 210 includes the white sub-pixel, the test data line 280 may further include a fourth test data line to which a white test data voltage is applied.

The voltage maintaining transistor 290 may include a gate terminal coupled to the control voltage line 293, a source terminal coupled to the internal voltage line 295, and a drain terminal coupled to the test gate line 285.

The sheet unit test may be performed simultaneously on a plurality of organic light emitting display devices 200*a* before the plurality of organic light emitting display devices 200*a* are scribed or separated from the mother substrate 100 of FIG. 1. For example, during the sheet unit test, the red test data voltage TD_R may be applied to the first test data line 281, the green test data voltage TD_G may be applied to the second test data line 282, the blue test data voltage TDB may be applied to the third test data line 283, and a first voltage (e.g., the low gate voltage VGL) may be applied to the test gate line 285. Thus, the plurality of test transistors TT1, TT2, TT3, TT4, TT5, TT6, TT7, TT8, and TT9 may be turned on in response to the low gate voltage VGL applied through the test gate line 285, and the red, green and blue test data voltages TD_R, TD_G, and TD_B from the first through third test data lines 281, 282, and 283 may be applied to the plurality of data lines DL1, DL2, DL3, DL4, DL5, DL6, DL7, DL8, and DL9.

During the sheet unit test, the scan driver 230 may sequentially apply the scan signal to the plurality of scan lines SL1, SL2, and SL3 by receiving the scan driving voltage and the scan control signal through the sheet unit line 121 of FIG. 1. Accordingly, the red, green, and blue test data voltages TD_R, TD_G, and TDB may be sequentially applied to the plurality of pixels PX included in the display unit 210 on a row basis and, thus, the sheet unit test, e.g., a lighting test, for the plurality of pixels PX may be performed. In some example embodiments, the red, green, and blue test data voltages TD_R, TD_G, and TD_B may sequentially have a logic high level to sequentially perform the lighting test for the red, green, and blue sub-pixels R, G, and B. In other example embodiments, the red, green, and blue test data voltages TD_R, TD_G, and TD_B may simultaneously have the logic high level to simultaneously perform the lighting test for the red, green and blue sub-pixels R, G, and B.

While the sheet unit test is performed, a second voltage (e.g., the high gate voltage VGH) may be applied to the control voltage line 293, and the voltage maintaining transistor 290 may be turned off in response to the high gate voltage VGH applied through the control voltage line 293. Accordingly, during the sheet unit test, the voltage maintaining transistor 290 may electrically decouple the internal voltage line 295 from the test gate line 285.

After the sheet unit test is completed, the organic light emitting display device 200*a* may be separated from the mother substrate 100 of FIG. 1, the data driver 260 may be mounted on the IC mounting region 250, and the organic light emitting display device 200*b* separated from the mother substrate 100 may perform the normal operation that displays an image based on image data received from an external device. During the normal operation, the data driver 260 may apply the data voltage corresponding to the image data to the plurality of data lines DL1, DL2, DL3, DL4, DL5, DL6, DL7, DL8, and DL9, and the scan driver 230 may sequentially apply the scan signal to the plurality of scan lines SL1, SL2, and SL3. Accordingly, the display unit 210 may display an image corresponding to the image data based on the data voltage and the scan signal.

During the normal operation of the organic light emitting display device 200*b*, the second voltage (e.g., the high gate voltage VGH) may be applied to the test gate line 285, and the plurality of test transistors TT1, TT2, TT3, TT4, TT5, TT6, TT7, TT8, and TT9 may be turned off in response to the high gate voltage VGH applied through the test gate line 285. Accordingly, the plurality of test transistors TT1, TT2, TT3, TT4, TT5, TT6, TT7, TT8, and TT9 may electrically decouple the first through third test data lines 281, 282, and 283 from the plurality of data lines DL1, DL2, DL3, DL4, DL5, DL6, DL7, DL8, and DL9. However, if the test gate line 285 is damaged, e.g., by a crack, a scratch, an electrostatic discharge (ESD), or the like, the test gate line 285 may be cut off, and, thus, the gate high voltage VGH for turning off the plurality of test transistors TT1, TT2, TT3, TT4, TT5, TT6, TT7, TT8, and TT9 may not be applied to gate terminals of the plurality of test transistors TT1, TT2, TT3, TT4, TT5, TT6, TT7, TT8, and TT9. In particular, a pad region of the test gate line 285 to which the high gate voltage VGH is applied may be vulnerable to damage.

In a conventional organic light emitting display device, once the test gate line 285 is damaged, the plurality of test transistors TT1, TT2, TT3, TT4, TT5, TT6, TT7, TT8, and TT9 may not be sufficiently turned off, and thus the plurality of data lines DL1, DL2, DL3, DL4, DL5, DL6, DL7, DL8, and DL9 may be coupled to each other through the first through third test data lines 281, 282 and 283. Accordingly, the data voltage applied from the data driver 260 to the respective data lines DL1, DL2, DL3, DL4, DL5, DL6, DL7, DL8, and DL9 may be shared by the plurality of data lines DL1, DL2, DL3, DL4, DL5, DL6, DL7, DL8, and DL9. For example, the data voltage applied to the respective data lines DL1, DL4, and DL7 corresponding to the red sub-pixels R may be shared by the data lines DL1, DL4, and DL7 through the first test data line 281, the data voltage applied to the respective data lines DL2, DL5, and DL8 corresponding to the green sub-pixels G may be shared by the data lines DL2, DL5, and DL8 through the second test data line 282, and the data voltage applied to the respective data lines DL3, DL6, and DL9 corresponding to the blue sub-pixels B may be shared by the data lines DL3, DL6, and DL9 through the third test data line 283. If the data voltage is shared by the plurality of data lines DL1, DL2, DL3, DL4, DL5, DL6, DL7, DL8, and DL9, the data voltage applied to each sub-pixel R, G, and B may not have a desired voltage level, and the display unit 210 may display an abnormal image. Accordingly, a conventional organic light emitting display device where the test gate line 285 is damaged should be discarded as a defective product, reducing yield.

However, in the organic light emitting display device 200*b* according to example embodiments, even if the test gate line 285 is damaged, the voltage maintaining transistor 290 may couple the internal voltage line 295 to the test gate line 285 to allow the test gate line 285 to maintain the second voltage (e.g., the high gate voltage VGH) during the normal operation. For example, during the normal operation, the voltage maintaining transistor 290 may be turned on in response to the low gate voltage VGL applied through the control voltage line 293, and may couple the internal voltage line 295 for providing components (e.g., the scan driver 230 or an emission driver) of the organic light emitting display device 200*b* with the high gate voltage VGH to the test gate line 285. In some example embodiments, at least one pad through which the low gate voltage VGL is applied to the control voltage line 293 may be formed. For example, the pads of the control voltage line 293 may be formed at both ends of the control voltage line 293 respectively located at both of the bottom left edge and the bottom right of the organic light emitting display device 200*b*. In this case, even if not only the test gate line 285 but also a pad region of one end of the control voltage line 293 is damaged, the control voltage line 293 may receive the low gate voltage VGL at the pad of the other end of the control voltage line 293. Thus, the voltage maintaining transistor 290 may be turned on to apply the high gate voltage VGH to the test gate line 285.

As described above, even if the high gate voltage VGH is not applied to the test gate line 285 through the pad since a pad region of the test gate line 285 is damaged, the high gate voltage VGH may be applied to the test gate line 285 through the voltage maintaining transistor 290 from the internal voltage line 295. That is, in the organic light emitting display device 200*b* according to example embodiments, the high gate voltage VGH may be applied to the test gate line 285 even if the test gate line 285 is damaged, and thus the plurality of test transistors TT1, TT2, TT3, TT4, TT5, TT6, TT7, TT8, and TT9 may be turned off to electrically decouple the first through third test data lines 281, 282, and 283 from the plurality of data lines DL1, DL2, DL3, DL4, DL5, DL6, DL7, DL8, and DL9. Accordingly, the organic light emitting display device 200*b* according to example embodiments may accurately display a desired image even if the test gate line 285 is damaged.

Figure 3:
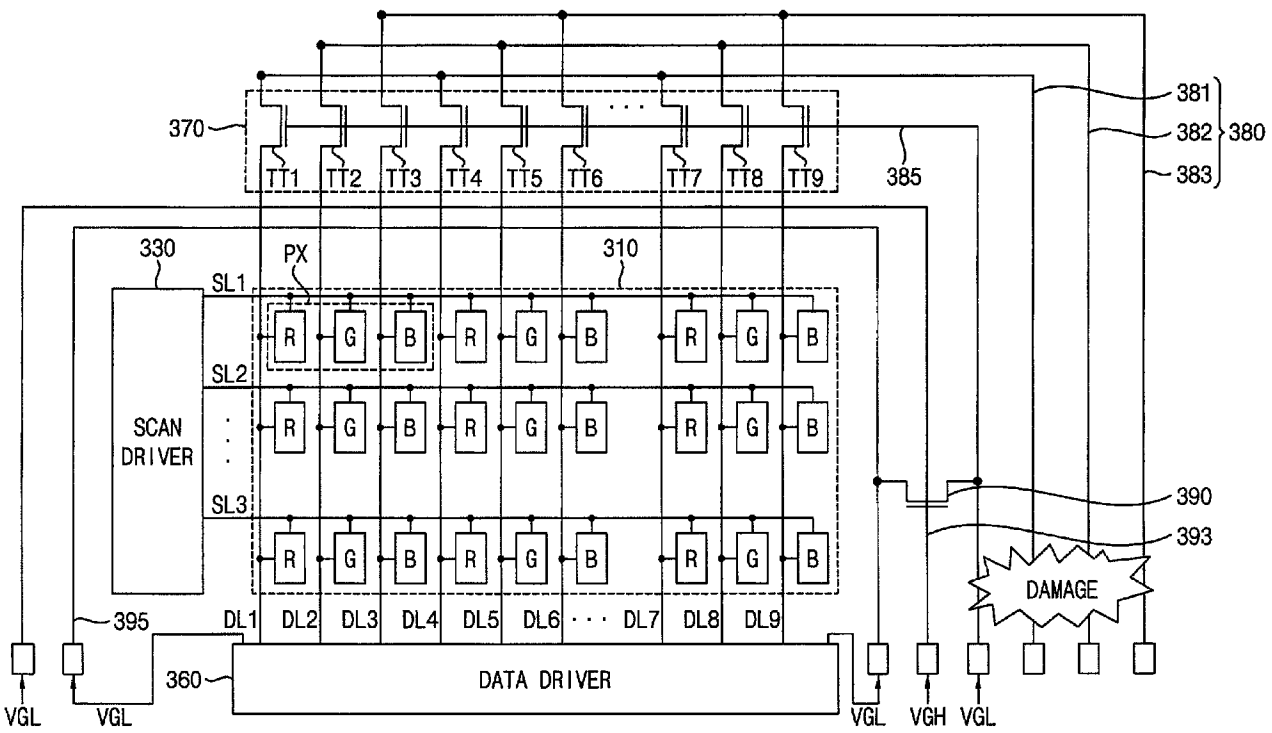
FIG. 3 is a diagram illustrating an organic light emitting display device in accordance with example embodiments.

FIG. 3 is a diagram illustrating an organic light emitting display device in accordance with example embodiments. Referring to FIG. 3, an organic light emitting display device 300 may include a display unit 310, a scan driver 330, a data driver 360, a test unit 370, a test data line 380, a test gate line 385, a voltage maintaining transistor 390, a control voltage line 393, and an internal voltage line 395. The organic light emitting display device 300 of FIG. 3 may have a similar configuration to an organic light emitting display device 200*b* of FIG. 2B, except that transistors included in the organic light emitting display device 300 of FIG. 3, for example a plurality of test transistors TT1, TT2, TT3, TT4, TT5, TT6, TT7, TT8, and TT9 and the voltage maintaining transistor 390 are implemented with NMOS transistor, rather than the PMOS transistors illustrated in FIG. 2B.

The display unit 310 may include a plurality of pixels PX coupled to a plurality of scan lines SL1, SL2, and SL3 and a plurality of data lines DL1, DL2, DL3, DL4, DL5, DL6, DL7, DL8, and DL9.

The test data line 380 may receive a test data voltage during a sheet unit test, and the test data line 380 may be floated or may receive a predetermined voltage during a normal operation. In some example embodiments, the test data line 380 may include first, second, and third test data lines 381, 382, and 383 respectively corresponding to red, green, and blue pixels. A first voltage (e.g., a high gate voltage VGH) may be applied to the test gate line 385 during the sheet unit test and a second voltage (e.g., a low gate voltage VGL) may be applied to the test gate line 385 during the normal operation.

The test unit 370 may include the plurality of test transistors TT1, TT2, TT3, TT4, TT5, TT6, TT7, TT8, and TT9 between the test data line 380 and the plurality of data lines DL1, DL2, DL3, DL4, DL5, DL6, DL7, DL8, and DL9. The plurality of test transistors TT1, TT2, TT3, TT4, TT5, TT6, TT7, TT8, and TT9 may selectively couple the first through third test data lines 381, 382, and 383 to the plurality of data lines DL1, DL2, DL3, DL4, DL5, DL6, DL7, DL8, and DL9 in response to the first voltage or the second voltage applied through the test gate line 385. For example, the plurality of test transistors TT1, TT2, TT3, TT4, TT5, TT6, TT7, TT8, and TT9 may couple the first through third test data lines 381, 382, and 383 to the plurality of data lines DL1, DL2, DL3, DL4, DL5, DL6, DL7, DL8, and DL9 in response to the high gate voltage VGH applied through test gate line 385 during the sheet unit test, and may electrically decouple the first through third test data lines 381, 382, and 383 from the plurality of data lines DL1, DL2, DL3, DL4, DL5, DL6, DL7, DL8, and DL9 in response to the low gate voltage VGL applied through test gate line 385 during the normal operation.

The internal voltage line 395 may receive the low gate voltage VGL from a sheet unit line 121 of FIG. 1 during the sheet unit test, and may receive the low gate voltage VGL from the data driver 360 during the normal operation. The low gate voltage VGL applied to the internal voltage line 395 may be provided to the scan driver 360 and/or an emission driver.

The voltage maintaining transistor 390 may couple the internal voltage line 395 to the test gate line 385, so that the test gate line 385 maintains the low gate voltage VGL during the normal operation even if the test gate line 385 is damaged. For example, the voltage maintaining transistor 390 may be turned off in response to the low gate voltage VGL applied through the control voltage line 393 to electrically decouple the internal voltage line 395 from the test gate line 385 during the sheet unit test, and may be turned on in response to the high gate voltage VGH applied through the control voltage line 393 to couple the internal voltage line 395 to the test gate line 385 during the normal operation.

During the normal operation of the organic light emitting display device 300, after the organic light emitting display device 300 is separated from a mother substrate and the data driver 360 is mounted, the low gate voltage VGL may be applied to the test gate line 385 through the internal voltage line 395 and the voltage maintaining transistor 390 even if the test gate line 385 is damaged. Thus, the plurality of test transistors TT1, TT2, TT3, TT4, TT5, TT6, TT7, TT8, and TT9 may be turned off in response to the low gate voltage VGL applied through the test gate line 385 to electrically decouple the first through third test data lines 381, 382, and 383 from the plurality of data lines DL1, DL2, DL3, DL4, DL5, DL6, DL7, DL8, and DL9. Accordingly, the organic light emitting display device 300 according to example embodiments may accurately display a desired image even if the test gate line 385 is damaged.

Figure 4:
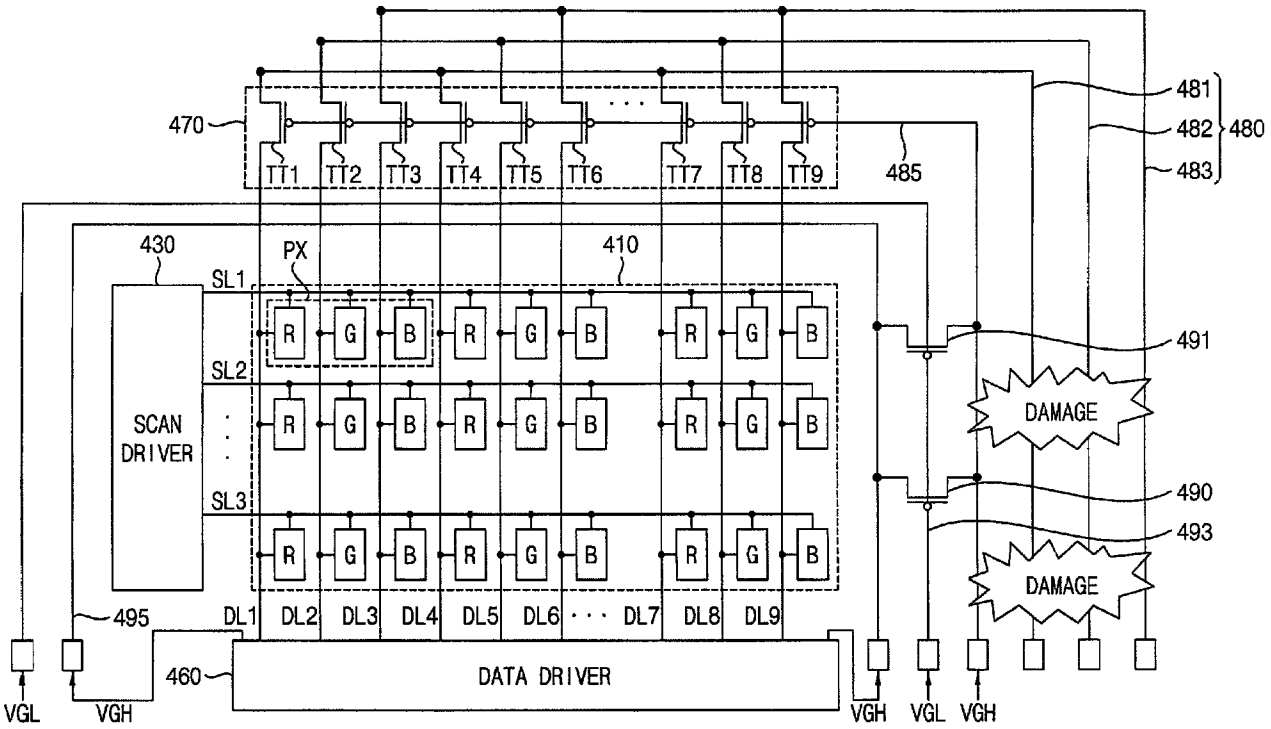
FIG. 4 is a diagram illustrating an organic light emitting display device in accordance with example embodiments.

FIG. 4 is a diagram illustrating an organic light emitting display device in accordance with example embodiments. Referring to FIG. 4, an organic light emitting display device 400 may include a display unit 410, a scan driver 430, a data driver 460, a test unit 470, a test data line 480, a test gate line 485, a plurality of voltage maintaining transistors 490 and 491, a control voltage line 493 and an internal voltage line 495. Compared with an organic light emitting display device 200*b* of FIG. 2, the organic light emitting display device 400 of FIG. 4 may further include at least one additional voltage maintaining transistor 491.

Each of the plurality of voltage maintaining transistors 490 and 491 may include a gate terminal coupled to the control voltage line 493, a source terminal coupled to the internal voltage line 495, and a drain terminal coupled to the test gate line 485. Since the organic light emitting display device 400 includes the plurality of voltage maintaining transistors 490 and 491, a high gate voltage VGH may be stably applied to the test gate line 485 during a normal operation of the organic light emitting display device 400. For example, even if not only a pad region of the test gate line 485 but also a region of the test gate line 485 above the first voltage maintaining transistor 490 is damaged, a second voltage maintaining transistor 491 may couple the internal voltage line 495 to the test gate line 485, and thus the high gate voltage VGH may be applied to the test gate line 485.

As described above, during the normal operation of the organic light emitting display device 400, the plurality of voltage maintaining transistors 490 and 491 may couple the internal voltage line 495 to the test gate line 485, and thus the high gate voltage VGH may be applied to the test gate line 485. Thus, the plurality of test transistors TT1, TT2, TT3, TT4, TT5, TT6, TT7, TT8, and TT9 may be turned off in response to the high gate voltage VGH applied through the test gate line 485 to electrically decouple first through third test data lines 481, 482, and 483 from a plurality of data lines DL1, DL2, DL3, DL4, DL5, DL6, DL7, DL8, and DL9. Accordingly, the organic light emitting display device 400 according to example embodiments may accurately display a desired image even if the test gate line 485 is damaged.

Figure 5:
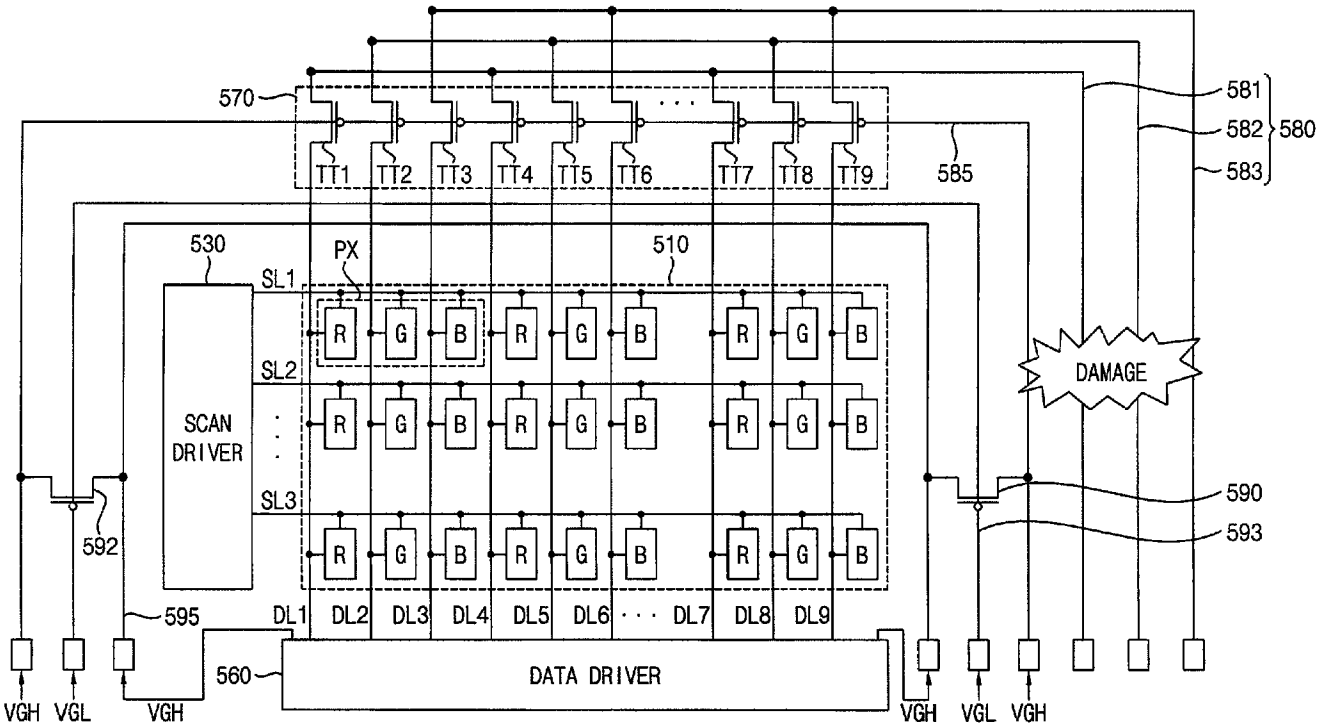
FIG. 5 is a diagram illustrating an organic light emitting display device in accordance with example embodiments.

FIG. 5 is a diagram illustrating an organic light emitting display device in accordance with example embodiments. Referring to FIG. 5, an organic light emitting display device 500 may include a display unit 510, a scan driver 530, a data driver 560, a test unit 570, a test data line 580, a test gate line 585, a plurality of voltage maintaining transistors 590 and 592, a control voltage line 593, and an internal voltage line 595. Compared with an organic light emitting display device 200*b* of FIG. 2B, the organic light emitting display device 500 of FIG. 5 may further include not only a first voltage maintaining transistor 590 disposed in a first direction from the display unit 510 but also a second voltage maintaining transistor 592 disposed in a second direction, opposite to the first direction, from the display unit 510, e.g., on opposite sides of the display unit 510.

Each of the plurality of voltage maintaining transistors 590 and 592 may include a gate terminal coupled to the control voltage line 593, a source terminal coupled to the internal voltage line 595, and a drain terminal coupled to the test gate line 585. The first voltage maintaining transistor 590 may be disposed in the first direction (e.g., a right direction) from the display unit 510, and the second voltage maintaining transistor 592 may be disposed in the second direction (e.g., a left direction) from the display unit 510. Since the organic light emitting display device 500 includes the first and second voltage maintaining transistors 590 and 592 respectively disposed in the right direction and the left direction from the display unit 510, a high gate voltage VGH may be stably applied to the test gate line 585 during a normal operation of the organic light emitting display device 500. For example, in a case where the test gate line 485 is damaged at the right of the display unit 510, the second voltage maintaining transistor 592 disposed in the left direction from the display unit 510 may couple the internal voltage line 595 to the test gate line 585 to apply the high gate voltage VGH to the test gate line 585. Further, in a case where the test gate line 485 is damaged at the left of the display unit 510, the first voltage maintaining transistor 590 disposed in the right direction from the display unit 510 may couple the internal voltage line 595 to the test gate line 585 to apply the high gate voltage VGH to the test gate line 585.

As described above, during the normal operation of the organic light emitting display device 500, the plurality of voltage maintaining transistors 590 and 592 at the left and right of the display unit 510 may couple the internal voltage line 595 to the test gate line 585, and thus the high gate voltage VGH may be applied to the test gate line 585 even if the test gate line 585 is damaged. Thus, the plurality of test transistors TT1, TT2, TT3, TT4, TT5, TT6, TT7, TT8, and TT9 may be turned off in response to the high gate voltage VGH applied through the test gate line 585 to electrically decouple first through third test data lines 581, 582, and 583 from a plurality of data lines DL1, DL2, DL3, DL4, DL5, DL6, DL7, DL8, and DL9. Accordingly, the organic light emitting display device 500 according to example embodiments may accurately display a desired image even if the test gate line 585 is damaged.

Figure 6:
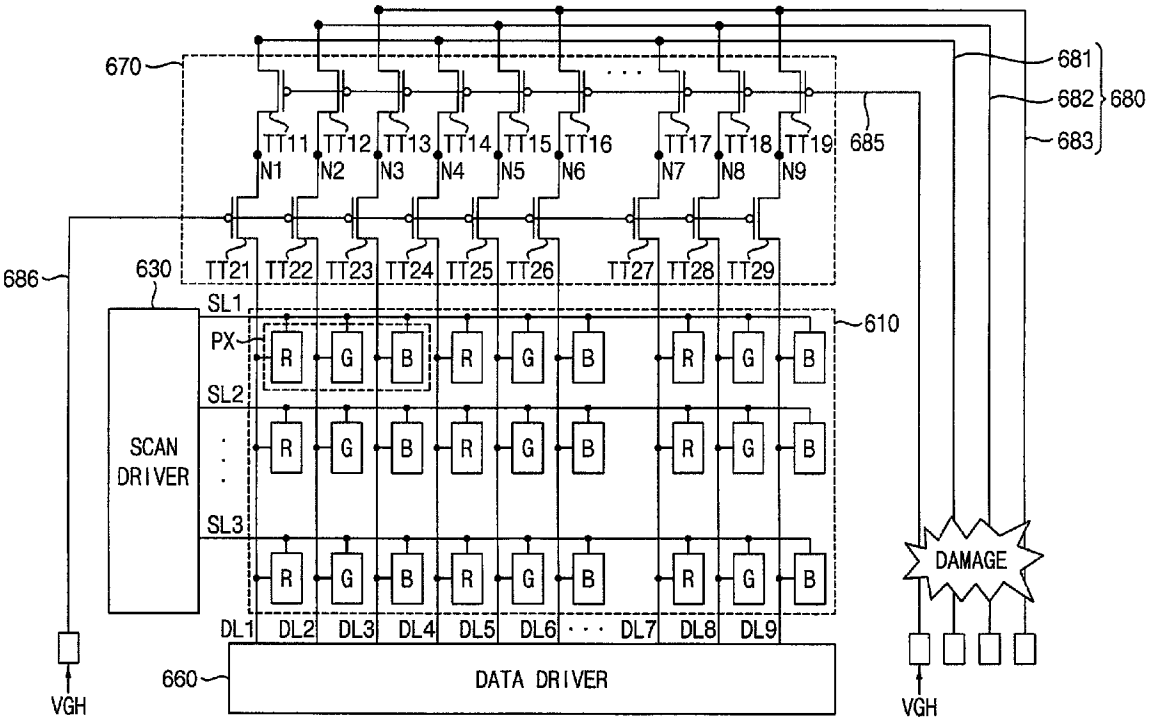
FIG. 6 is a diagram illustrating an organic light emitting display device in accordance with example embodiments.

FIG. 6 is a diagram illustrating an organic light emitting display device in accordance with example embodiments. Referring to FIG. 6, an organic light emitting display device 600 may include a display unit 610, a scan driver 630, a data driver 660, a test unit 670, a test data line 680, a first test gate line 685, and a second test gate line 686.

The display unit 610 may include a plurality of pixels PX coupled to a plurality of scan lines SL1, SL2 and SL3 and a plurality of data lines DL1, DL2, DL3, DL4, DL5, DL6, DL7, DL8 and DL9.

The test unit 670 may include a plurality of first test transistors TT11, TT12, TT13, TT14, TT15, TT16, TT17, TT18, and TT19 that selectively couple the test data line 680 to a plurality of nodes N1, N2, N3, N4, N5, N6, N7, N8, and N9 in response to a voltage applied through the first test gate line 685, and a plurality of second test transistors TT21, TT22, TT23, TT24, TT25, TT26, TT27, TT28, and TT29 that selectively couple the plurality of nodes N1, N2, N3, N4, N5, N6, N7, N8, and N9 to the plurality of data lines DL1, DL2, DL3, DL4, DL5, DL6, DL7, DL8, and DL9 in response to a voltage applied through the second test gate line 686. Each of the first test transistors TT11, TT12, TT13, TT14, TT15, TT16, TT17, TT18, and TT19 may be coupled in series with a corresponding one of the second test transistors TT21, TT22, TT23, TT24, TT25, TT26, TT27, TT28, and TT29. Each of the first test transistors TT11, TT12, TT13, TT14, TT15, TT16, TT17, TT18, and TT19 may include a gate terminal coupled to the first test gate line 685, a source terminal coupled to the test data line 680, and a drain terminal coupled to a corresponding one of the plurality of nodes N1, N2, N3, N4, N5, N6, N7, N8, and N9. Each of the second test transistors TT21, TT22, TT23, TT24, TT25, TT26, TT27, TT28, and TT29 may include a gate terminal coupled to the second test gate line 686, a source terminal coupled to a corresponding one of the plurality of nodes N1, N2, N3, N4, N5, N6, N7, N8, and N9, and a drain terminal coupled to a corresponding one of the plurality of data lines DL1, DL2, DL3, DL4, DL5, DL6, DL7, DL8, and DL9.

During a sheet unit test, a test data voltage may be applied to the test data line 680, and a low gate voltage VGL may be applied to the first and second test gate lines 685 and 686. During the sheet unit test, the first test transistors TT11, TT12, TT13, TT14, TT15, TT16, TT17, TT18, and TT19 may couple the test data line 680 to the plurality of nodes N1, N2, N3, N4, N5, N6, N7, N8, and N9 in response to the low gate voltage VGL applied through the first test gate line 685, and the second test transistors TT21, TT22, TT23, TT24, TT25, TT26, TT27, TT28, and TT29 may couple the plurality of nodes N1, N2, N3, N4, N5, N6, N7, N8, and N9 to the plurality of data lines DL1, DL2, DL3, DL4, DL5, DL6, DL7, DL8, and DL9 in response to the low gate voltage VGL applied through the second test gate line 686. Accordingly, during the sheet unit test, the test data line 680 may be coupled to the plurality of data lines DL1, DL2, DL3, DL4, DL5, DL6, DL7, DL8, and DL9 through the first test transistors TT11, TT12, TT13, TT14, TT15, TT16, TT17, TT18, and TT19, and the second test transistors TT21, TT22, TT23, TT24, TT25, TT26, TT27, TT28, and TT29, and the test data voltage applied to the test data line 680 may be provided to the plurality of data lines DL1, DL2, DL3, DL4, DL5, DL6, DL7, DL8, and DL9.

During a normal operation of the organic light emitting display device 600, a high gate voltage VGH may be applied to the first and second test gate lines 685 and 686. Thus, the first test transistors TT11, TT12, TT13, TT14, TT15, TT16, TT17, TT18, and TT19 and the second test transistors TT21, TT22, TT23, TT24, TT25, TT26, TT27, TT28, and TT29 may be turned off to electrically decouple the test data line 680 from the plurality of data lines DL1, DL2, DL3, DL4, DL5, DL6, DL7, DL8, and DL9. Even if one of the first test gate line 685 and the second test gate line 686 is damaged, the other of the first test gate line 685 and the second test gate line 686 may electrically decouple the test data line 680 from the plurality of data lines DL1, DL2, DL3, DL4, DL5, DL6, DL7, DL8, and DL9. For example, even if the first test gate line 685 is damaged during the normal operation, the second test transistors TT21, TT22, TT23, TT24, TT25, TT26, TT27, TT28, and TT29 may be turned off in response to the second test gate line 686, and thus the test data line 680 may be electrically decoupled from the plurality of data lines DL1, DL2, DL3, DL4, DL5, DL6, DL7, DL8, and DL9.

In some example embodiments, at least a portion of the first test gate line 685 (e.g., a pad region of the first test gate line 685) may be disposed in a first direction (e.g., a right direction) from the display unit 610, and at least a portion of the second test gate line 686 (e.g., a pad region of the second test gate line 686) may be disposed in a second direction (e.g., a left direction) opposite to the first direction from the display unit 610. Accordingly, even if a damage occurs at a right region or a bottom right region of the organic light emitting display device 600 and the first test gate line 685 is cut off, the second test transistors TT21, TT22, TT23, TT24, TT25, TT26, TT27, TT28, and TT29 coupled to the second test gate line 686 may electrically decouple the test data line 680 from the plurality of data lines DL1, DL2, DL3, DL4, DL5, DL6, DL7, DL8, and DL9. Further, even if damage occurs at a left region or a bottom left region of the organic light emitting display device 600 and the second test gate line 686 is cut off, the first test transistors TT11, TT12, TT13, TT14, TT15, TT16, TT17, TT18, and TT19 coupled to the first test gate line 685 may electrically decouple the test data line 680 from the plurality of data lines DL1, DL2, DL3, DL4, DL5, DL6, DL7, DL8, and DL9.

As described above, during the normal operation of the organic light emitting display device 600, the first test transistors TT11, TT12, TT13, TT14, TT15, TT16, TT17, TT18, and TT19 coupled to the first test gate line 685 and the second test transistors TT21, TT22, TT23, TT24, TT25, TT26, TT27, TT28, and TT29 coupled to the second test gate line 686 may electrically decouple first through third test data lines 681, 682, and 683 from the plurality of data lines DL1, DL2, DL3, DL4, DL5, DL6, DL7, DL8, and DL9. Thus, even if either the first test gate line 685 or the second test gate line 686 is damaged, the first through third test data lines 681, 682, and 683 may be electrically decoupled from the plurality of data lines DL1, DL2, DL3, DL4, DL5, DL6, DL7, DL8, and DL9. Accordingly, the organic light emitting display device 600 according to example embodiments may accurately display a desired image even if the first test gate line 685 or the second test gate line 686 is damaged.

Figure 7:
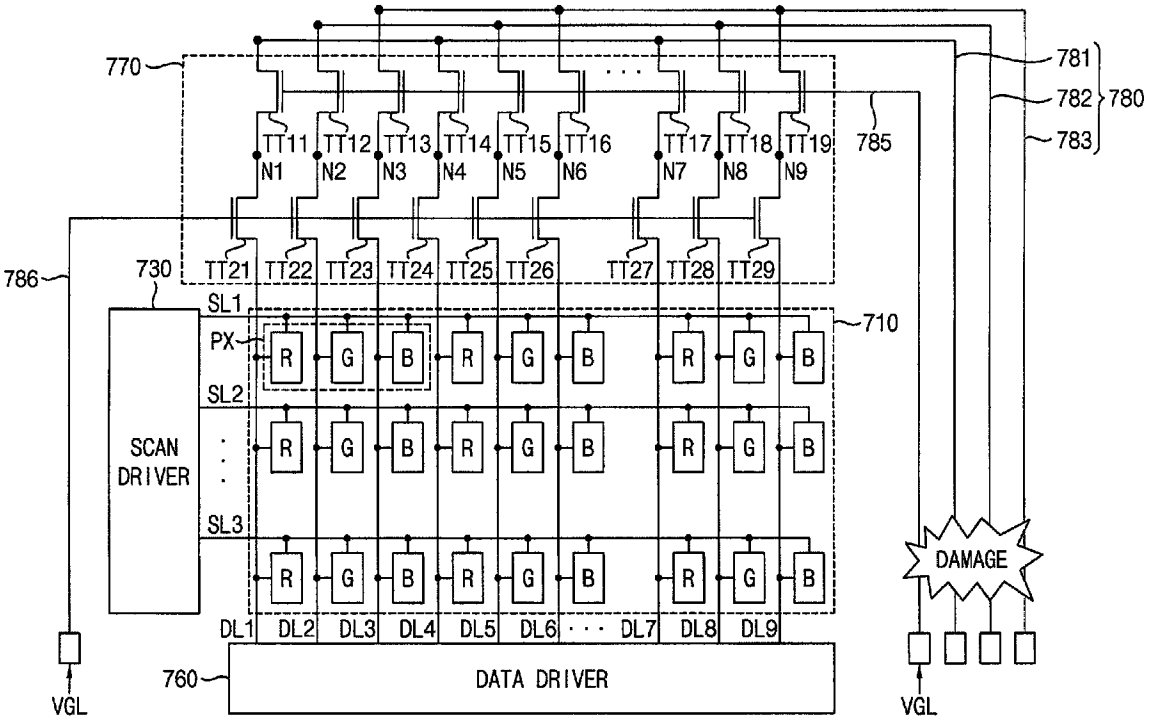
FIG. 7 is a diagram illustrating an organic light emitting display device in accordance with example embodiments.

FIG. 7 is a diagram illustrating an organic light emitting display device in accordance with example embodiments. Referring to FIG. 7, an organic light emitting display device 700 may include a display unit 710, a scan driver 730, a data driver 760, a test unit 770, a test data line 780, a first test gate line 785 and a second test gate line 786. The organic light emitting display device 700 of FIG. 7 may have a similar configuration to an organic light emitting display device 600 of FIG. 6, except that transistors included in the organic light emitting display device 700 of FIG. 7, for example, the plurality of first test transistors TT11, TT12, TT13, TT14, TT15, TT16, TT17, TT18, and TT19 and the plurality of second test transistors TT21, TT22, TT23, TT24, TT25, TT26, TT27, TT28, and TT29 are implemented with NMOS transistors, rather than the PMOS transistors of FIG. 6.

During a normal operation of the organic light emitting display device 700, a low gate voltage VGL may be applied to the first test gate line 785 and the second test gate line 786. Accordingly, the first test transistors TT11, TT12, TT13, TT14, TT15, TT16, TT17, TT18, and TT19 and the second test transistors TT21, TT22, TT23, TT24, TT25, TT26, TT27, TT28, and TT29 may be turned off, and thus the test data line 780 may be electrically decoupled from the plurality of data lines DL1, DL2, DL3, DL4, DL5, DL6, DL7, DL8, and DL9.

Even if one of the first test gate line 785 and the second test gate line 786 is damaged, a plurality of test transistors coupled to the other of the first test gate line 785 and the second test gate line 786 may electrically decouple the test data line 780 from the plurality of data lines DL1, DL2, DL3, DL4, DL5, DL6, DL7, DL8, and DL9.

As described above, during the normal operation of the organic light emitting display device 700, the first test transistors TT11, TT12, TT13, TT14, TT15, TT16, TT17, TT18, and TT19 coupled to the first test gate line 785 and the second test transistors TT21, TT22, TT23, TT24, TT25, TT26, TT27, TT28, and TT29 coupled to the second test gate line 786 may electrically decouple first through third test data lines 781, 782 and 783 from the plurality of data lines DL1, DL2, DL3, DL4, DL5, DL6, DL7, DL8, and DL9. Thus, even if either the first test gate line 785 or the second test gate line 786 is damaged, the first through third test data lines 781, 782, and 783 may be electrically decoupled from the plurality of data lines DL1, DL2, DL3, DL4, DL5, DL6, DL7, DL8, and DL9. Accordingly, the organic light emitting display device 700 according to example embodiments may accurately display a desired image even if the first test gate line 785 or the second test gate line 786 is damaged.

Figure 8:
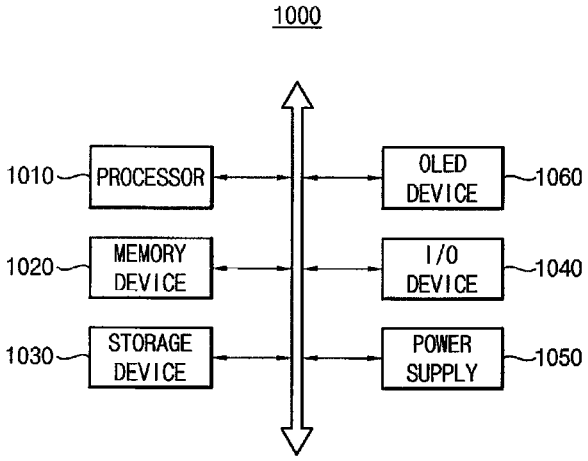
FIG. 8 is a block diagram illustrating an electronic system including an organic light emitting display device in accordance with example embodiments.

FIG. 8 is a block diagram illustrating an electronic system including an organic light emitting display device in accordance with example embodiments. Referring to FIG. 8, an electronic system 1000 includes a processor 1010, a memory device 1020, a storage device 1030, an input/output (I/O) device 1040, a power supply 1050, and an organic light emitting display device 1060. The electronic system 1000 may further include a plurality of ports for communicating a video card, a sound card, a memory card, a universal serial bus (USB) device, other electronic systems, etc.

The processor 1010 may perform various computing functions or tasks. The processor 1010 may be for example, a microprocessor, a central processing unit (CPU), etc. The processor 1010 may be connected to other components via an address bus, a control bus, a data bus, etc. Further, the processor 1010 may be coupled to an extended bus such as a peripheral component interconnection (PCI) bus.

The memory device 1020 may store data for operations of the electronic system 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1030 may be, for example, a solid state drive (SSD) device, a hard disk drive (HDD) device, a CD-ROM device, etc. The I/O device 1040 may be, for example, an input device such as a keyboard, a keypad, a mouse, a touch screen, etc, and/or an output device such as a printer, a speaker, etc. The power supply 1050 may supply power for operations of the electronic system 1000. The organic light emitting display device 1060 may communicate with other components via the buses or other communication links.

The organic light emitting display device 1060 may be one of the organic light emitting display devices 200*b*, 300, 400, 500, 600, and 700 of FIGS. 2B through 7. The organic light emitting display device 1060 may electrically decouple a test voltage line from a display unit during a normal operation even if a test gate line is damaged by using at least one redundant element, e.g., at least one voltage maintaining transistor or additional test transistors connected in series with typical test transistors.

The present embodiments may be applied to any electronic system 1000 having an organic light emitting display device. For example, the present embodiments may be applied to the electronic system 1000, such as a television, a computer monitor, a laptop computer, a tablet computer, a digital camera, a cellular phone, a smart phone, a personal digital assistant (PDA), a portable multimedia player (PMP), a MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. An organic light emitting display device, comprising:

a display unit including a plurality of pixels coupled to a plurality of scan lines and a plurality of data lines;

a test data line to which a test data voltage is applied during a sheet unit test;

a test gate line to which a first voltage is applied during the sheet unit test and to which a second voltage is applied during a normal operation of the organic light emitting display device;

a plurality of test transistors configured to selectively couple the test data line to the plurality of data lines in response to the first voltage or the second voltage applied through the test gate line;

an internal voltage line to which the second voltage is applied; and at least one voltage maintaining transistor configured to couple the internal voltage line to the test gate line during the normal operation.

2. The organic light emitting display device of claim 1, wherein:

during the sheet unit test, the at least one voltage maintaining transistor is turned off to decouple the internal voltage line from the test gate line, and during the normal operation, the at least one voltage maintaining transistor is turned on to couple the internal voltage line to the test gate line such that the test gate line maintains the second voltage even if the test gate line is damaged.

3. The organic light emitting display device of claim 1, further comprising:

a control voltage line coupled to the at least one voltage maintaining transistor, wherein the second voltage is applied to the control voltage line during the sheet unit test, and the first voltage is applied to the control voltage line during the normal operation.

4. The organic light emitting display device of claim 3, wherein the at least one voltage maintaining transistor has a gate terminal coupled to the control voltage line, a source terminal coupled to the internal voltage line, and a drain terminal coupled to the test gate line.

5. The organic light emitting display device of claim 3, wherein the at least one voltage maintaining transistor comprises:

a plurality of voltage maintaining transistors, each voltage maintaining transistor having a gate terminal coupled to the control voltage line, a source terminal coupled to the internal voltage line, and a drain terminal coupled to the test gate line.

6. The organic light emitting display device of claim 3, wherein the at least one voltage maintaining transistor comprises:

a first voltage maintaining transistor having a gate terminal coupled to the control voltage line, a source terminal coupled to the internal voltage line, and a drain terminal coupled to the test gate line, the first voltage maintaining transistor being disposed in a first direction from the displaying unit; and a second voltage maintaining transistor having a gate terminal coupled to the control voltage line, a source terminal coupled to the internal voltage line, and a drain terminal coupled to the test gate line, the second voltage maintaining transistor being disposed in a second direction opposite to the first direction from the displaying unit.

7. The organic light emitting display device of claim 1, wherein the plurality of test transistors are configured to couple the test data line to the plurality of data lines in response to the first voltage applied through the test gate line during the sheet unit test, and are configured to decouple the test data line from the plurality of data lines in response to the second voltage applied through the test gate line during the normal operation.

8. The organic light emitting display device of claim 1, wherein the plurality of test transistors and the at least one voltage maintaining transistor are implemented with PMOS transistors.

9. The organic light emitting display device of claim 8, wherein the first voltage is a low gate voltage and the second voltage is a high gate voltage.

10. The organic light emitting display device of claim 1, wherein the plurality of test transistors and the at least one voltage maintaining transistor are implemented with NMOS transistors.

11. The organic light emitting display device of claim 10, wherein the first voltage is a high gate voltage and the second voltage is a low gate voltage.

12. An organic light emitting display device, comprising:

a display unit including a plurality of pixels coupled to a plurality of scan lines and a plurality of data lines;

a test data line to which a test data voltage is applied during a sheet unit test;

a first test gate line to which a first voltage is applied during the sheet unit test and to which a second voltage is applied during a normal operation of the organic light emitting display device;

a plurality of first test transistors configured to selectively couple the test data line to a plurality of nodes in response to the first voltage or the second voltage applied through the first test gate line;

a second test gate line to which the first voltage is applied during the sheet unit test and to which the second voltage is applied during the normal operation; and a plurality of second test transistors configured to selectively couple the plurality of nodes to the plurality of data lines in response to the first voltage or the second voltage applied through the second test gate line, each of the second test transistors being coupled in series with a corresponding one of the first test transistors.

13. The organic light emitting display device of claim 12, wherein the first test gate line is disposed in a first direction from the displaying unit, and the second test gate line is disposed in a second direction opposite to the first direction from the displaying unit.

14. The organic light emitting display device of claim 12, wherein the first test transistors are configured to couple the test data line to the plurality of nodes in response to the first voltage applied through the first test gate line during the sheet unit test, and wherein the second test transistors are configured to couple the plurality of nodes to the plurality of data lines in response to the first voltage applied through the second test gate line during the sheet unit test.

15. The organic light emitting display device of claim 12, wherein, even if one of the first and second test gate lines is damaged, the first test transistors or the second test transistors coupled to the other one of the first and second test gate lines decouple the test data line from the plurality of data lines in response to the second voltage applied through the other one of the first and second test gate lines during the normal operation.

16. The organic light emitting display device of claim 12, wherein:

each of the first test transistors has a gate terminal coupled to the first test gate line, a source terminal coupled to the test data line, and a drain terminal coupled to a corresponding one of the plurality of nodes, and each of the second test transistors has a gate terminal coupled to the second test gate line, a source terminal coupled to a corresponding one of the plurality of nodes, and a drain terminal coupled to a corresponding one of the plurality of data lines.

17. The organic light emitting display device of claim 12, wherein the first test transistors and the second test transistors are implemented with PMOS transistors.

18. The organic light emitting display device of claim 17, wherein the first voltage is a low gate voltage and the second voltage is a high gate voltage.

19. The organic light emitting display device of claim 12, wherein the first test transistors and the second test transistors are implemented with NMOS transistors.

20. The organic light emitting display device of claim 19, wherein the first voltage is a high gate voltage and the second voltage is a low gate voltage.

* * * * *